United States Patent [19]

Whitney

[11] 4,061,277

[45] Dec. 6, 1977

[54] SHREDDER WITH GRATE CARTRIDGE

[75] Inventor: Richard P. Whitney, East Moline, Ill.

[73] Assignee: Sivyer Steel Corporation, Milwaukee, Wis.

[21] Appl. No.: 725,031

[22] Filed: Sept. 20, 1976

[51] Int. Cl.[2] ..... B02C 23/10

[52] U.S. Cl. ..... 241/73; 241/88; 241/89.2

[58] Field of Search ..... 241/86.1, 88, 88.4, 241/89.1, 89.2, 89.3, 190, 221, 243, 299, 300, 73

[56] References Cited

U.S. PATENT DOCUMENTS

| | | | |
|---|---|---|---|
| 763,639 | 6/1904 | Schoellhorn et al. | 241/88 |
| 792,485 | 6/1905 | Williams | 241/88 |
| 953,111 | 3/1910 | Williams | 241/88 |
| 3,465,973 | 9/1969 | Williams | 241/89.3 |
| 3,722,805 | 3/1973 | Strom | 241/88 |
| 3,727,848 | 4/1973 | Francis | 241/197 |
| 3,987,971 | 10/1976 | McClure | 241/73 |
| 4,015,783 | 4/1977 | Miller | 241/73 |

*Primary Examiner*—Granville Y. Custer, Jr.
*Attorney, Agent, or Firm*—Quarles & Brady

[57] ABSTRACT

A shredder for reducing scrap materials such as scrapped automobiles to pieces of a smaller size includes a shredder housing having an inlet and an outlet, rotary hammer means positioned in said housing, cutter means, means for rotating said hammer means to coact with said cutter means to reduce the material to smaller pieces, and an improved discharge grate positioned across said outlet through which such pieces must pass to leave the housing, said improved discharge grate comprising a plurality of grate segments secured within a frame which can be readily opened and reclosed so that a grate segment can be replaced. In a preferred embodiment, the outlet and the grate are located in the end wall of said housing about 180° from the inlet.

6 Claims, 5 Drawing Figures

SHREDDER WITH GRATE CARTRIDGE

BACKGROUND OF THE INVENTION

There is a continuing need for improvements in shredders for reducing scrap metal materials, especially scrapped automobiles, into convenient size pieces for use in steel mills. Such shredders have been known for a long time but there are basic problems that have never been solved. One problem is how to reduce the scrap metal material to the desired size pieces with a minimum consumption of energy. Another problem is how to get the maximum use from the shredder components such as grates and to reduce the downtime involved in replacing worn or broken components.

In the past, a variety of attempts have been made to solve these problems including designing shredders with more efficient and durable rotors and hammers and different shaped housings. However, such attempts have not been completely successful.

Representative of a type of shredder which is now widely used is that shown and described in the Newell U.S. Pat. No. 3,482,788. Although the performance of the Newell-type shredder can be improved by employing therein the improved four-arm rotor design and the protective arm caps shown in the Francis U.S. Pat. No. 3,727,848, the energy consumption of the Newell-type shredder is still higher than desired and the internal surfaces of the housing and the grate appear to wear excessively and unevenly.

SUMMARY OF THE INVENTION

It is an object of this invention to disclose a shredder for reducing scrap materials, such as automobiles, to pieces of useful size with a minimum consumption of energy, while obtaining maximum life from the components including the grate.

The shredder of the present invention comprises a shredder housing having an inlet and an outlet, a rotating hammer means located within said housing, a rigidly mounted cutter comb, means for rotating said hammer means to coact with the cutter comb to reduce the scrap materials to smaller size pieces and an improved discharge grate positioned across said outlet through which such pieces must pass to leave the housing, said grate comprising a plurality of grate segments secured within a frame which can be readily opened and reclosed so that a grate segment can be replaced. The grate cartridge is preferably located in the end wall of said housing about 180° from the inlet.

In the preferred embodiment the individual grate segments are so constructed that the position of the top and bottom of the grate in the frame can be reversed so that the useful life of the grate can be extended. In addition, in a preferred embodiment, the openings in the grate through which the pieces must pass to leave the housing are orientated to approximate the angle at which the pieces leave the hammer path so that the pieces of shredded material the size of the grate openings or smaller will pass through the grate as soon as possible as opposed to striking the grate and being bounced back into the reach of the hammers and being repeatedly banged against the grate and other internal components.

Less energy will be consumed when the preferred grate is used since the pieces of scrap material leave the shredder promptly upon reaching the desired size rather than being subjected to repeated and unnecessary hammering within the housing. In addition, the use of the preferred grate cartridge provides significant indirect energy savings by extending the life of not only the grate itself but also of the internal plates and components which normally are repeatedly struck or contacted by the shredded pieces of the desired size which have not been able to leave the shredder housing.

Positioning the improved grate cartridge in the end wall of the housing approximately 180° from the normal inlet also has been found to have the beneficial effect of conserving energy and reducing wear on the internal surfaces of the housing and ultimately the wear on other components of the shredder. It has been discovered that in the conventional Newell-type shredder, once the pieces of scrap have obtained the desired size which will pass through the grate openings located in the top of the Newell machine, they attempt to leave the housing of the shredder at a point approximately 180° from the inlet, that is, at a point in the vertical end wall of the housing. Therefore, it is at this point that the grate cartridge is preferably positioned.

The novel grate cartridge also provides several significant advantages over the conventional one-piece grate. For example, the use of the grate cartridge can significantly reduce the downtime normally involved in replacing the grate of a shredder. Presently, no one can predict exactly when a portion of the grate will wear to the point that the entire grate must be replaced, and as a result many times a grate is worn to the point where it must be replaced when a new one is not readily available. However, with the grate cartridge, in most instances, a new and usable grate surface may be obtained by simply opening the frame and replacing, rearranging or reversing the grate segments, and then reclosing the frame.

Still another advantage of the improved grate cartridge is that it makes possible significant savings in the cost of the grate material. For example, at times only one particular portion of the total grate wears excessively to the point that it can no longer be used even though the remaining portions of the grate are still usable. When this occurs with a conventional one-piece grate, the entire grate must be replaced or rebuilt. On the other hand, when this occurs with the grate cartridge of the present invention, only the segment which has been worn to the point requiring replacement has to be removed and replaced with a new segment. Since the preferred grate segments are interchangeable even wear of a total grate surface and longer grate life can be achieved.

Although the shredder owner having a shredder using a conventional one-piece grate could minimize expensive downtime by having a second grate in reserve, the cost of a complete grate is significant and as a practical matter most shredder owners do keep extra grates in reserve. However, the shredder owner using the grate cartridge of the present invention will be able to significantly reduce downtime by having only a replacement segment or at the most two in reserve to replace those that are worn and cannot be reversed or rearranged.

It is, therefore, an object of the present invention to disclose a grate cartridge which is comprised of a plurality of grate segments held together by a frame which can be opened and reclosed so that the grate segments can be replaced, rearranged or reversed to maximize the life of the grate and reduce the amount of "throwaway" grate material.

It is a further object of this invention to provide a grate cartridge in which the openings in the grate are orientated to approximate the path which the pieces of shredded materials which have attained the desired size take as they leave the hammers so that the maximum number of the pieces of desired size will pass through the openings in the grate and leave the shredder.

It is also an object of the invention to position the grate cartridge in the end wall of the shredder housing at about 180° from the inlet or at the point at which the pieces of desired size cause the maximum wear on the internal plates and surfaces of the housing thereby reducing the replacement costs for such internal plates and surfaces.

A more limited object is to provide the particular structures herein disclosed.

The foregoing and other objects and advantages will appear from the following description. In that description, reference is made to the accompanying drawings which form a part thereof and in which there is shown by way of illustration and not of limitation a preferred embodiment of the invention.

DESCRIPTION OF THE PREFERRED EMBODIMENT

Referring to the accompanying drawings, the numeral 10 designates generally a fragmentizing chamber of a hammermill or shredder which has a rotary hammer assembly 11 mounted therein.

Figure 1:
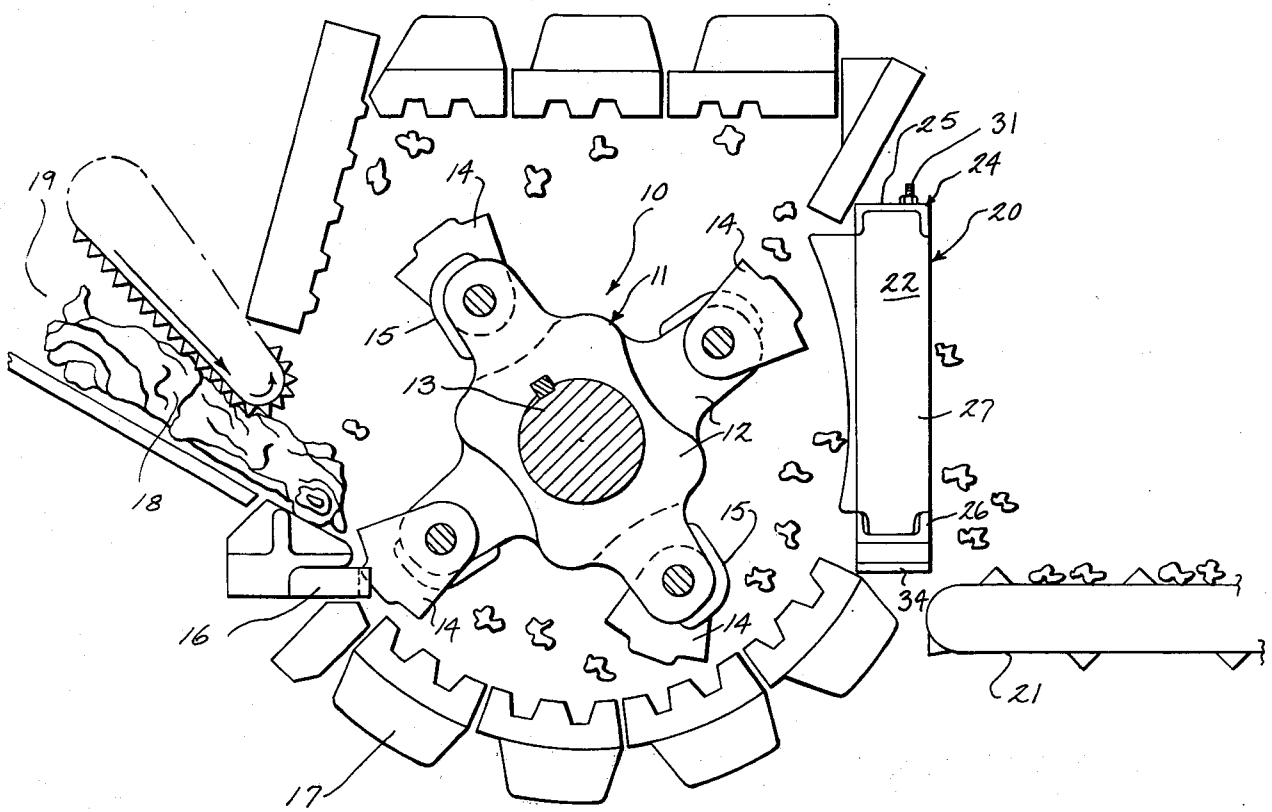
FIG. 1 is a sectional view through a hammermill embodying the present invention.

The hammer assembly 11 comprises a series of four-arm spiders 12 mounted on and keyed to a shaft 13 which is journaled in bearings (not shown) that are structurally supported in the side walls of the shredder. As seen in FIG. 1, the hammers 14 are mounted on the ends of said spider arms 12 so that the hammers can freely swing and the ends of the arms of the spider are provided with the protective caps 15 described in the Francis U.S. Pat. No. 3,727,848.

The hammers 14 coact with the teeth of a rigidly mounted cutting comb 16 that extends lengthwise of the hammer assembly and with the cutter bars 17, that are circumferentially spaced about the lower part of the orbit of the hammers so as to break up any material 18 entering the shredder through the inlet 19. The pieces of fragments into which the shredder breaks the incoming materials are propelled through openings **20*a* (not shown in FIG. 1) in the grate cartridge 20 and onto a conveyor 21** which carries them out of the mill or shredder.

Figure 2:
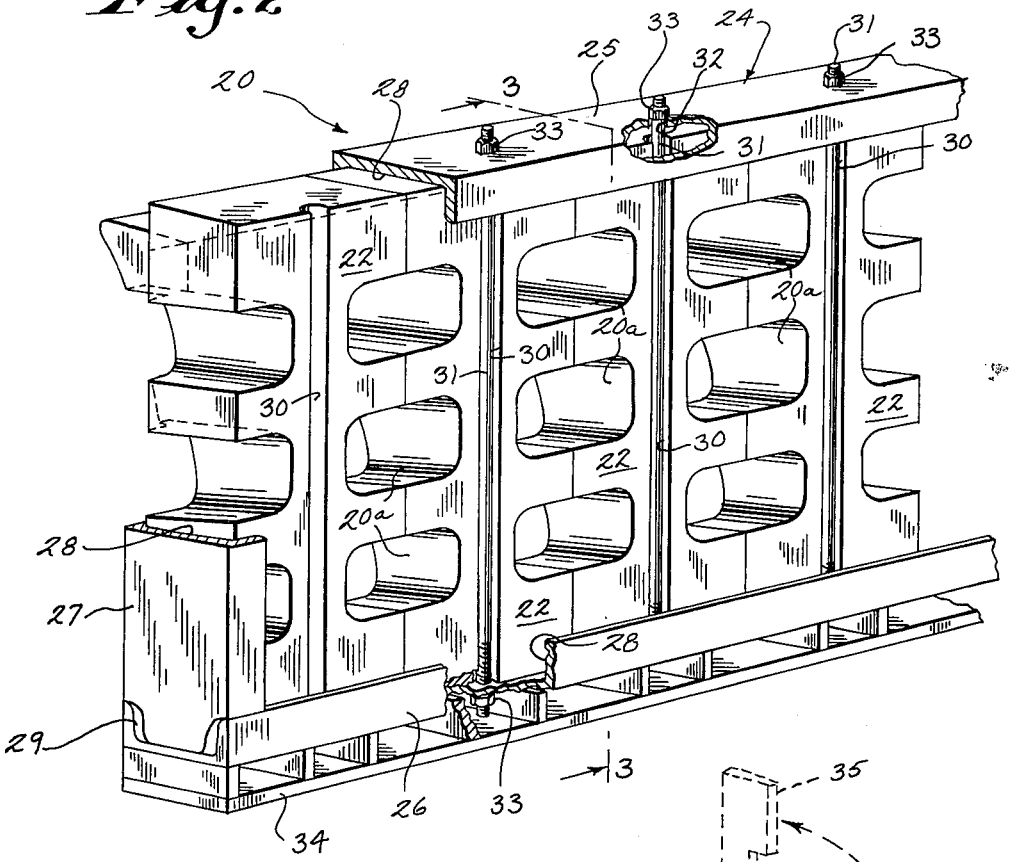
FIG. 2 is a perspective view partially in section of one embodiment of the grate cartridge.

Turning now to FIG. 2, it can be seen that the grate cartridge 20 is comprised of a plurality of grate segments 22 which are positioned within a frame 24 comprised of a top piece 25, a bottom piece 26 and two side pieces 27 (only one of which is shown). Each of the pieces 25, 26 and 27 of the frame is provided with a U-shaped channel 28 adapted to receive the appropriate portion of the periphery of a grate segment. In addition, the top piece 25 and the bottom piece 26 are provided with modified end portions 29 (only one of which is shown) which retain the ends of the side pieces 27 and 28 within the U-shaped channels of the top piece 25 and bottom piece 26 when they are positioned as shown in FIG. 2.

As also seen in FIG. 2, each of the grate segments 22 is provided with a vertically extending recess 30 which is adapted to receive a tie rod 31 which is threaded on both ends. In addition, the top piece 25 and the bottom piece 26 of the frame 24 are provided with openings 32 through which the ends of the tie rods extend. As seen in FIG. 2, the components of the frame 24 and the grate segments 22 are secured to form a unit by the tie rods 31 which are positioned in the recesses 30 and which extend through openings 32 in the top piece 25 and openings 32 in the bottom piece 26 and the tie rod nuts 33. If desired, the top piece 25 and bottom piece 26 can be provided with a spacer 34 to accept the tie rod nuts 33 and ends of the tie rod 31 to form a frame with an uninterrupted exterior surface. Alternatively, the opening in the vertical end wall of the shredder housing (not shown) which receives and secures the grate cartridge can be provided with recesses to receive the tie rod ends and nuts 33.

Figure 4:
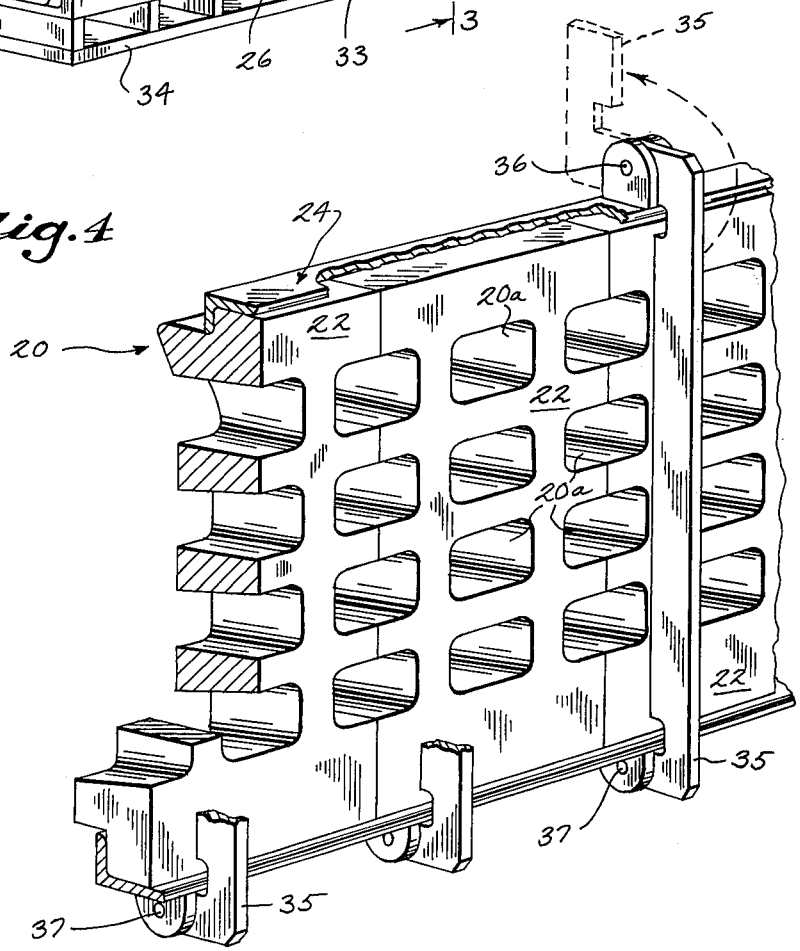
FIG. 4 is a perspective view of another embodiment of the grate segment.

Turning to FIG. 4, it will be apparent that, if desired, other forms of retaining the grate segments 22 within the frame 24 can be employed. For example, the segments 22 can be held within the frame 24 by catches 35 or equivalent retaining means which can, if desired, be made an internal part of the housing of the shredder as can the frame 24, in which case only the segments 22 would be removable.

Figure 3:
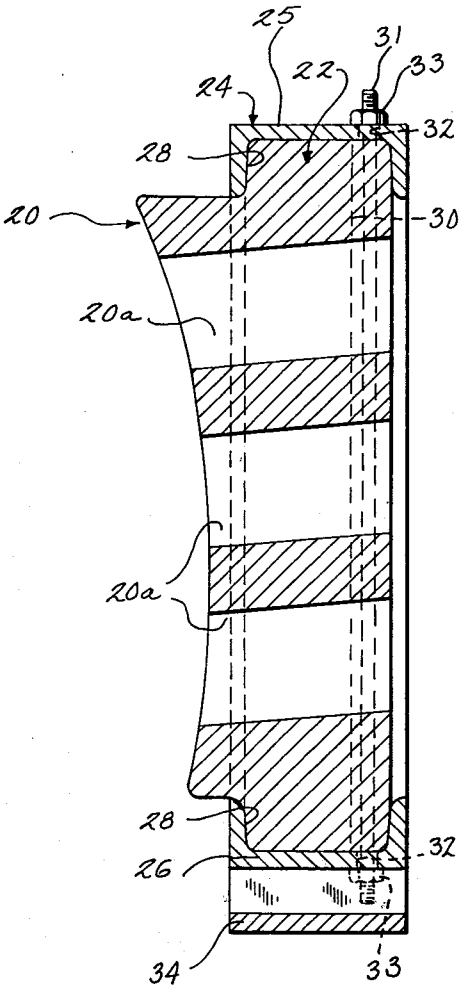
FIG. 3 is a sectional view through FIG. 2 on the plane of the line 3—3.

Turning to FIG. 3, it can be seen that in the preferred embodiment the top and bottom walls of the openings **20*a*** in the grate are orientated at an angle which deviates from the horizontal. In the preferred practice, when the grate is positioned in the end wall at about 180° from the inlet, the angle is about 10° to 50° above the horizontal. However, the angle will vary depending upon where the grate is located. In fact, when the grate cartridge is used with the conventional Newell-type shredder having a top discharge outlet, the openings in the grate segments may be substantially parallel to the tops and bottoms and sides of the grate segment. In any event, the orientation of the openings in the grate segments should approximate the path the pieces of desired size take when leaving the hammer circle so that the maximum number of such pieces pass through the grate at the earliest opportunity.

Figure 5:
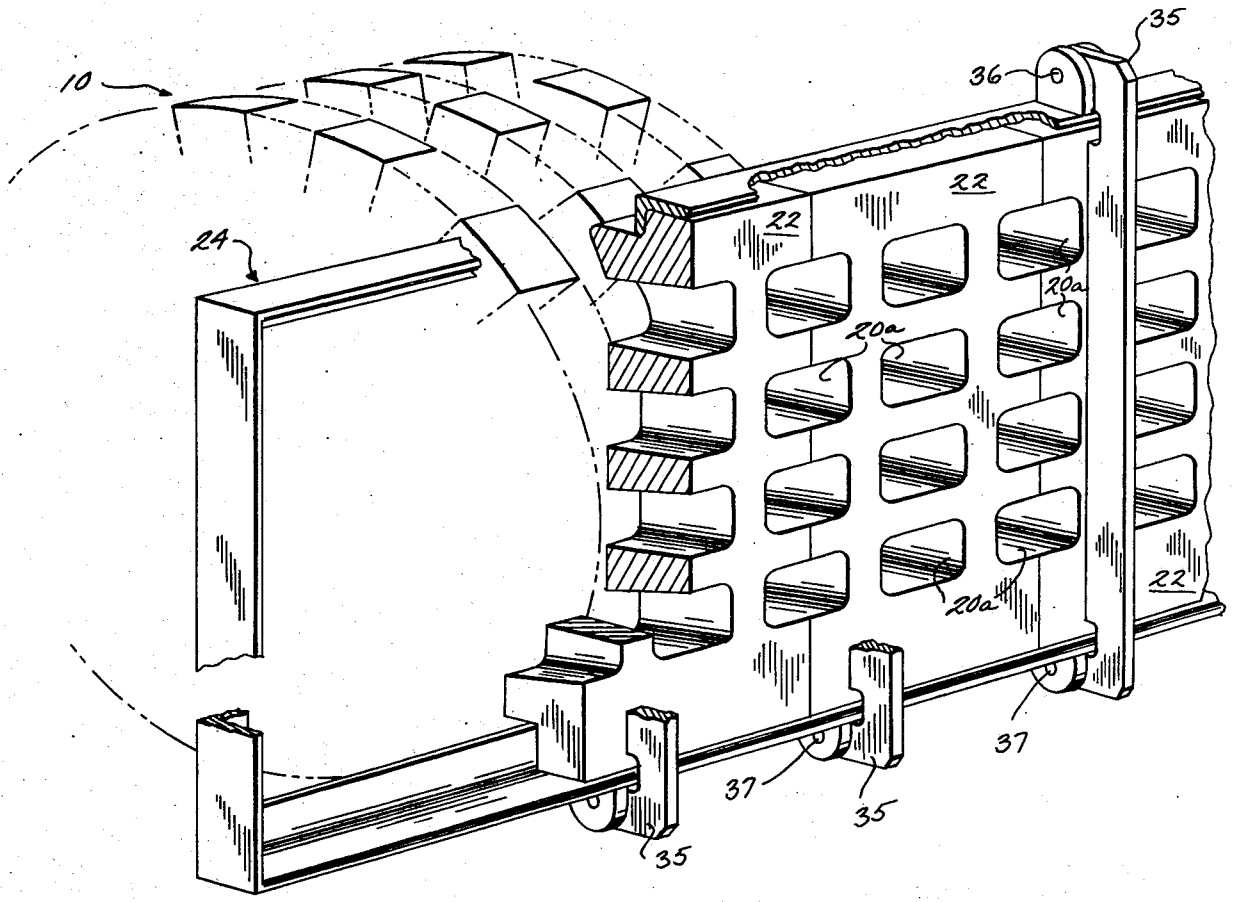
FIG. 5 is a schematic view showing the hammer circle and the alternative grate.

Returning now to FIG. 4, in which an alternative embodiment of the grate segment 22 is shown, can be seen that the frame 24 is an integral part of the end wall of the housing and is provided with catches 35 which are attached to the frame 24 by pivot pins 36 so it can be swung open as indicated in broken lines to permit the removal of the grate segment 22 and then closed as shown in straight lines to retain the grate segments 22 in place. In the embodiment shown in FIGS. 4 and 5, the catches 35 are provided with openings (not shown) to receive the retaining pins 37 to lock the catches in place.

From the foregoing, it is readily apparent that significant energy savings can be accomplished by using the grate cartridge of the present invention, especially when the embodiment employed is one in which the openings in the grate are orientated to approximate the angle at which the pieces of desired size leave the hammer circle.

It will also be apparent to those skilled in the art that a grate cartridge has been disclosed which will greatly extend the life and reduce the cost of grate materials.

While in the foregoing description a preferred embodiment has been set forth for purposes of explanation, it will be understood that many variations and changes may be made without departing from the spirit and scope of the invention.

I claim:

1. In a shredder of the type used to reduce scrap materials such as scrapped automobiles to pieces of a desired size, which shredder comprises a housing having a top, a bottom and side walls and an inlet and an outlet, rotary hammer means positioned in the interior of said housing, cutter means, means for rotating said hammer means to coact with the cutter means so as to reduce the scrap materials entering said housing via said inlet to pieces of a desired and a grate closing the outlet to pieces larger than the desired size, the improvement which comprises locating the outlet of the shredder in a side wall at a point approximately 180° from the inlet and closing said outlet with an improved grate which includes a frame having a top piece, a bottom piece and side pieces, a plurality of grate segments having top and bottom edges adapted to be received in the top piece and bottom piece of the frame, respectively, said segments being removably secured within said frame to form a unitary grate having openings through which pieces of the desired size can exit from the housing, and means removably securing the segments within the frame which means can be opened and closed from outside the shedder housing to permit the grate segments to be removed from the frame.

2. The grate of claim 1 in which the means removably securing the grate segments within the frame are tie rods which permit the frame to be assembled and disassembled so that the individual grate segments can be removed and added.

3. The grate of claim 1 in which the means securing the segments with the frame are catches which can be opened and closed from outside the shredder housing so as to permit the removal of grate segments.

4. A grate for use in a shredder of the type used to reduce scrap materials such as scrapped automobiles to pieces of a desired size, which shredder comprises a housing having an inlet and an outlet, rotary hammer means positioned in the interior of said housing, cutter means, means for rotating said hammer means to coact with the cutter means so as to reduce scrapped materials entering the housing via the inlet to pieces of scrap of a desired size and a grate closing the outlet to pieces larger than the desired size, the improved grate which comprises a frame having a top piece, a bottom piece and end pieces, a plurality of grate segments having opposed peripheral edges adapted to be received in opposedperipheral edges adapted to be received in opposed pieces of said frame, said segments being removably secured within said frame to form a unitary grate having openings through which pieces of scrap of the desired size can pass, and means removably securing the grate segments within the frame which means can be opened and closed from outside the housing to permit the grate segments to be removed from and added to the frame.

5. The grate of claim 4 in which the means removably securing the grate segments within the frame are tie rods which permit the grate to be assembled and disassembled so that the individual grate segments can be removed and added.

6. The grate of claim 4 in which the means securing the grate segments within the frame are catches which can be opened and closed to permit the grate segments to be removed.

* * * * *

UNITED STATES PATENT AND TRADEMARK OFFICE

CERTIFICATE OF CORRECTION

PATENT NO. : 4,061,277

DATED : December 6, 1977

INVENTOR(S) : Richard P. Whitney

It is certified that error appears in the above-identified patent and that said Letters Patent are hereby corrected as shown below:

Column 3, line 56, change "of" to --or--.

Column 4, line 33, change "internal" to --integral--.

Claim 1, line 9, after "desired" insert --size--.

Claim 3, line 2, change "with" to --within--.

Claim 4, line 19, delete "opposed peripheral edges adapted to be received in";

line 20, change "opposedperipheral" to --opposed peripheral--.

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*